US012716158B2

(12) United States Patent
Xiong et al.

(10) Patent No.: US 12,716,158 B2
(45) Date of Patent: Aug. 25, 2026

(54) CLOTHING TREATMENT DEVICE

(71) Applicant: WUXI LITTLE SWAN ELECTRIC CO., LTD., Jiangsu (CN)

(72) Inventors: Lining Xiong, Wuxi (CN); Yacheng Shi, Wuxi (CN); Jia Wang, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 112 days.

(21) Appl. No.: 18/638,993

(22) Filed: Apr. 18, 2024

(65) Prior Publication Data

US 2025/0283266 A1 Sep. 11, 2025

(30) Foreign Application Priority Data

Mar. 6, 2024 (CN) ..... 202410254055.9

(51) Int. Cl.
*D06F 37/24* (2006.01)
*D06F 37/26* (2006.01)

(52) U.S. Cl.
CPC ..... *D06F 37/24* (2013.01); *D06F 37/268* (2013.01)

(58) Field of Classification Search
CPC ..... D06F 37/28; D06F 37/268
See application file for complete search history.

(56) References Cited

U.S. PATENT DOCUMENTS 9,809,919 B2 11/2017 Yu
9,915,018 B2 3/2018 Kim
11,035,065 B2 6/2021 Yu
11,427,949 B2 8/2022 Han
2011/0167878 A1* 7/2011 De Angelo Sanchez ..... D06F 37/268 68/212
2014/0060120 A1 3/2014 Yu
2016/0369444 A1* 12/2016 Kim ..... D06F 37/268
2017/0183802 A1* 6/2017 Yu ..... D06F 37/24
2018/0142403 A1* 5/2018 Han ..... D06F 37/20
(Continued)

FOREIGN PATENT DOCUMENTS

CN 103215785 A 7/2013
CN 104294539 A 1/2015
CN 108166212 A 6/2018
(Continued)

OTHER PUBLICATIONS

Machine translation of CN-117403417 A to Chen et al. (Year: 2024).*
(Continued)

*Primary Examiner* — Joseph L. Perrin
(74) *Attorney, Agent, or Firm* — SCULLY, SCOTT, MURPHY & PRESSER, P.C.

(57) ABSTRACT

A clothing treatment device is provided. The device includes a housing, a tub assembly, a first rod and a damping assembly. The damping assembly includes a first connection end and a second connection end. The first connection end is connected to the tub assembly, and the second connection end is connected to the first rod. At least one of the first connection end or the second connection end is provided with a through hole. In directions from axially opposite ends of the through hole to an middle position of the through hole along an axial direction thereof, a hole wall of the through hole extends toward an axis of the through hole.

13 Claims, 12 Drawing Sheets

(56) References Cited

U.S. PATENT DOCUMENTS

2021/0172106 A1* 6/2021 Han ..... D06F 23/04

FOREIGN PATENT DOCUMENTS

| | | | | | |
|---|---|---|---|---|---|
| CN | 207919165 | U | | 9/2018 | |
| CN | 108691146 | A | | 10/2018 | |
| CN | 109208254 | A | | 1/2019 | |
| CN | 109306601 | A | | 2/2019 | |
| CN | 109778494 | A | | 5/2019 | |
| CN | 111172713 | A | | 5/2020 | |
| CN | 218232845 | U | | 1/2023 | |
| CN | 117403417 | A | * | 1/2024 | ..... D06F 37/24 |
| CN | 117403418 | A | * | 1/2024 | ..... D06F 37/24 |
| JP | 59-212548 | A | | 12/1984 | |
| JP | 11-351317 | A | | 12/1999 | |
| KR | 10-2004-0058726 | A | | 7/2004 | |
| KR | 10-2016-0026933 | A | | 3/2016 | |
| KR | 10-2016-0029519 | A | | 3/2016 | |
| KR | 10-2016-0130695 | A | | 11/2016 | |

OTHER PUBLICATIONS

Machine translation of CN-117403418 A to Wang et al. (Year: 2024).*

International Search Report dated Jun. 19, 2025 received in International Application No. PCT/CN2025/081012.

Written Opinion of the International Searching Authority dated Jun. 19, 2025 received in International Application No. PCT/CN2025/081012.

International Search Report dated May 20, 2025 received in International Application No. PCT/CN2025/081019.

Written Opinion of the International Searching Authority dated May 20, 2025 received in International Application No. PCT/CN2025/081019.

International Search Report dated Dec. 4, 2024 received in International Application No. PCT/CN2024/090203.

Written Opinion of the International Searching Authority dated Dec. 4, 2024 received in International Application No. PCT/CN2024/090203.

International Search Report dated Dec. 4, 2024 received in International Application No. PCT/CN2024/090201.

Written Opinion of the International Searching Authority dated Dec. 4, 2024 received in International Application No. PCT/CN2024/090201.

* cited by examiner

CLOTHING TREATMENT DEVICE

FIELD

The disclosure relates to the field of clothing treatment, and in particular to a clothing treatment device.

BACKGROUND

A pulsator clothing treatment device is taken as an example, in case that an external size of a housing is unchanged, a gap between a tub assembly and the housing becomes smaller and smaller with the increase of a washing volume. During washing or spin-drying, the tub assembly may vibrate and deflect, and is prone to hitting the housing, which affects safety of the clothing treatment device during operation.

In order to reduce amplitude of the tub assembly, the clothing treatment device can be provided with a damper, an end of the damper is connected to the tub assembly, another end of the damper is connected to a suspender, the connection end of the damper rotates around a circumferential direction of the suspender or slides along the suspender, and when the tub assembly vibrates, the damper moves with the tub assembly to dissipate vibration energy. However, when the damper moves with vibration of the tub assembly, there is a high probability of sticking the damper, which affects damping effect and may even lead to damage of the damper.

SUMMARY

In view of this, it is desirable for embodiments of the disclosure to provide a clothing treatment device, in which a damping assembly has enough movement degree of freedom (DOF), high movement smoothness and high damping reliability.

An embodiment of the disclosure provides a clothing treatment device, and the clothing treatment device includes a housing, a tub assembly, a first rod, and a damping assembly.

The tub assembly is arranged in the housing.

The first rod is arranged out of the tub assembly.

The damping assembly includes a first connection end and a second connection end, the first connection end is connected to the tub assembly, and the second connection end is connected to the first rod.

At least one of the first connection end or the second connection end is provided with a through hole, and in directions from axially opposite ends of the through hole to an middle position of the through hole along an axial direction thereof, a hole wall of the through hole extends toward an axis of the through hole.

In some implementations, the through hole may be symmetrical with respect to a first plane, and the first plane is a plane perpendicular to the axis of the through hole and passing through the middle position of the through hole along the axial direction thereof.

In some implementations, in a longitudinal cross section passing through the axis of the through hole, at least a part of cross section of the hole wall of the through hole may be in a shape of an arc projecting toward the axis of the through hole.

In some implementations, at least a part of cross section of the hole wall of the through hole may be in a shape of a circular arc.

In some implementations, the damping assembly may include a first movement member, a second movement member and a friction member, the first movement member is connected to the second movement member, and the first movement member and the second movement member are relatively rotatable around their joint, the friction member is arranged at the rotation joint of the first movement member and the second movement member, to provide friction force to achieve damping when the first movement member and the second movement member rotate relatively, an end of the first movement member away from the friction member defines the first connection end, and an end of the second movement member away from the friction member defines the second connection end.

In some implementations, an axis around which the first movement member and the second movement member rotate relatively may be substantially parallel to an axis of the tub assembly.

In some implementations, a first end of the first movement member may be connected to a first end of the second movement member, and when the tub assembly is in a stationary state, an angle between a line connecting centers of first and second ends of the first movement member and a line connecting centers of first and second ends of the second movement member is not less than 50° and not greater than 120°.

In some implementations, the clothing treatment device may include a second rod extending in a height direction and fixed to an outer circumferential side of the tub assembly, an end of the first movement member away from the friction member is sleeved on an outer circumference of the second rod, and the through hole is arranged at the second connection end.

In some implementations, the entire first movement member may be a rigid member and may have only one rotation DOF; and/or, the entire second movement member may be a rigid member.

In some implementations, the clothing treatment device may include multiple suspenders, an end of each of the suspenders is connected to the tub assembly, another end of each of the suspenders is connected to the housing, the tub assembly is suspended from the housing by multiple suspenders, the first rod is a part of the suspender, or the first rod is connected to the suspender.

Alternatively, the clothing treatment device may include an operation platform arranged at a top end of the housing, an end of the first rod is connected to the operation platform, and another end of the first rod extends downward from the operation platform.

Alternatively, the clothing treatment device may include a mounting seat arranged on the housing, and at least one end of the first rod is arranged on the mounting seat.

According to the clothing treatment device provided in the embodiments of the disclosure, when the tub assembly vibrates and deflects, the damping assembly achieves up-down movement, circumferential rotation and up-down swing relative to the tub assembly or the first rod through the through hole, to adapt to variation of vibration displacement of the tub assembly, an end of the damping assembly connected to the tub assembly or an end of the damping assembly connected to a component out of the tub assembly has at least three movement DOFs, and the damping assembly has high movement smoothness and low sticking probability, thereby facilitating the damping assembly to buffer vibration of the tub assembly, and reducing a probability of the tub assembly hitting the housing. Furthermore, the damping assembly has at least three movement DOFs through the structure of the through hole only, which also enables the overall structure of the damping assembly to be simpler and manufactured easily.

Figure 1:
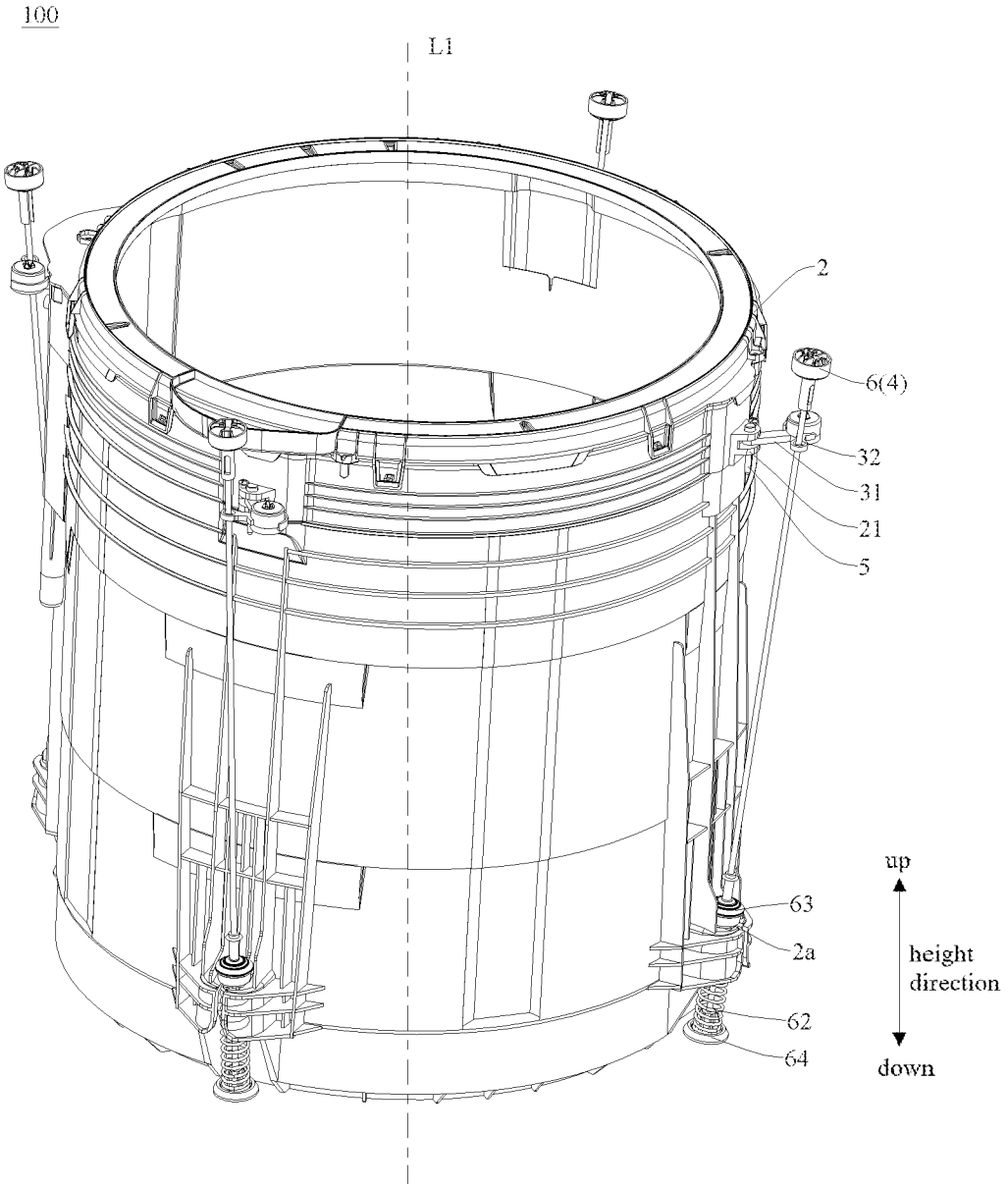
FIG. 1 is a schematic structural diagram of a clothing treatment device according to an embodiment of the disclosure.
Figure 2:
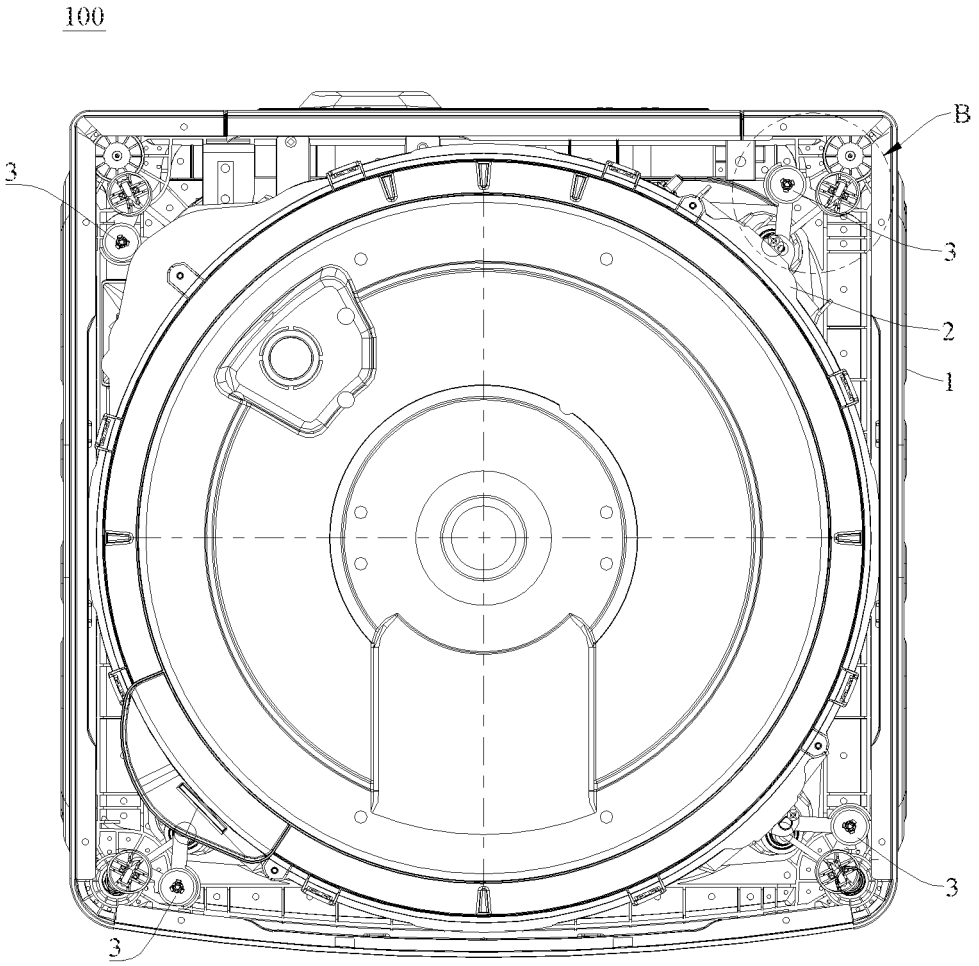
FIG. 2 is a schematic structural diagram of the structure shown in FIG. 1 from another perspective.
Figure 3:
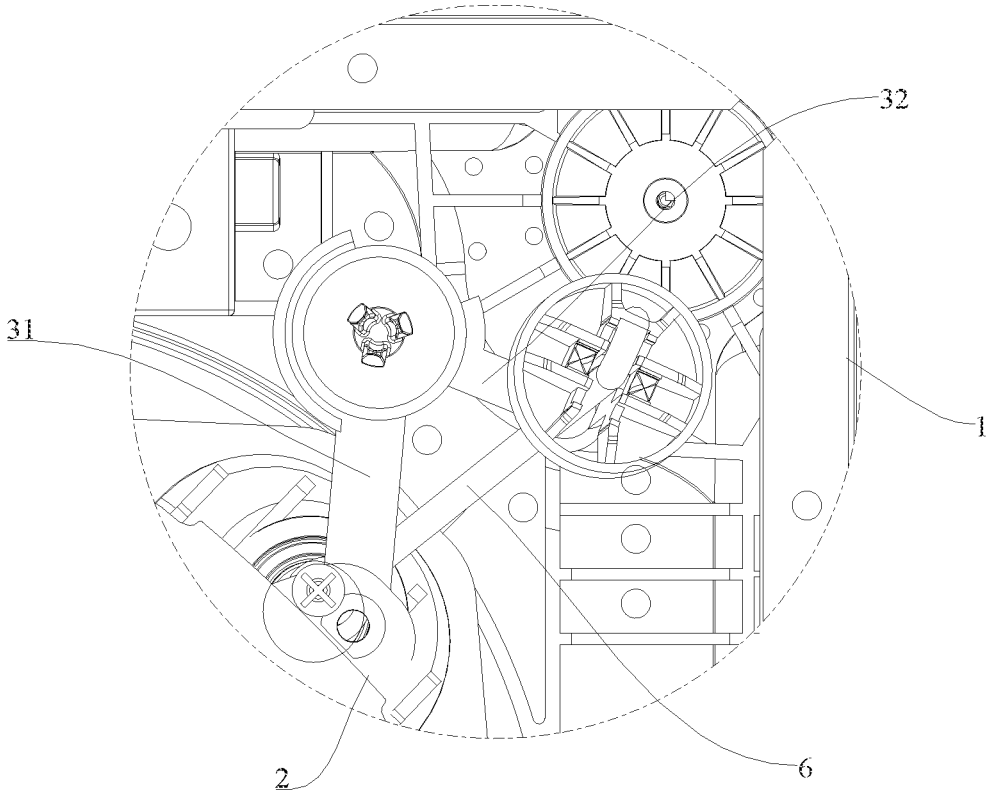
FIG. 3 is a schematic enlarged view at B of FIG. 2.

Description of reference numerals is provided as follows:

100—clothing treatment device;

1—housing; 11—mounting seat;

2—tub assembly; 21—mounting block; 2*a*—connection slot;

3—damping assembly; 31—first movement member; 311—first connection seat; 3111—first annular portion; 3112—first end plate; 3113—elastic hook; 3114—limit structure; 32—second movement member; 321—second connection seat; 3211—second annular portion; 3212—second end plate; 3212*a*—penetration hole; 32*a*—through hole; 33—friction member; 3*a*—first position; 3*b*—second position;

4—first rod;

5—second rod;

6—suspender; 62—damping spring; 63—damping cylinder; 64—base; and

7—operation platform.

DETAILED DESCRIPTION

In order to make the object, technical solutions and advantages of the disclosure more apparent, the disclosure will be further described in detail below with reference to the drawings and embodiments. It should be understood that specific embodiments described here are only intended to explain the disclosure and are not intended to limit the disclosure.

Various specific technical features described in the specific embodiments may be combined in any suitable manner without conflict, for example, different embodiments and technical solutions may be formed by combinations of different specific technical features. In order to avoid unnecessary repetition, various possible combinations of various specific technical features in the disclosure are not described any more.

Terms "first\second\ . . . " involved in the following descriptions are only intended to distinguish different objects, and do not mean that there are similarities or relationships between objects. It should be understood that descriptions related to orientations "above", "below", "outside" and "inside" are all orientations in a normal usage state, and directions "left" and "right" indicate left and right directions shown in a specific corresponding schematic diagram, which may be or may not be left and right directions in a normal usage state.

It should be noted that terms "include", "including" or any other variant thereof are intended to encompass non-exclusive inclusion, so that a process, method, article or device including a series of elements includes not only those elements, but also other elements which are not listed clearly, or elements inherent to such process, method, article or device. In absence of any further limitation, an element defined by a phrase "include a . . . " does not preclude existence of another identical element in a process, method, article or device including this element. "Multiple" means equal to or greater than two.

Embodiments of the disclosure provide a clothing treatment device 100, with reference to FIG. 1 to FIG. 13, the clothing treatment device 100 includes a housing 1, a tub assembly 2, a first rod 4, and a damping assembly 3.

It may be understood that specific form of the clothing treatment device 100 is not limited, and may be an existing pulsator washing machine, a drum washing machine or the like, which is not limited here; preferably, the damping assembly 3 described in the embodiments of the disclosure has better usage effect on the pulsator washing machine.

The tub assembly 2 is arranged in the housing 1.

It may be understood that the tub assembly 2 may include a drum and a tub, the drum is arranged inside the tub, and a space within the drum defines a clothing treatment chamber. The drum may be a perforated drum or a non-perforated drum. When the drum is a perforated drum, water is held by the tub; when the drum is a non-perforated drum, water is held by the drum itself, that is, both water and clothes may be held in the drum, and water in the drum may not enter the tub during washing. In some embodiments, the tub assembly 2 may be provided with only the drum and is not provided with the tub, and at this time, the drum is a non-perforated drum.

The housing 1 may provide an accommodation space and protection for the tub assembly 2, isolate the tub assembly 2 from the external environment, and reduce a probability of impurities such as dust from the external environment or the like contacting the tub assembly 2. When the clothing treatment device 100 is impacted, the housing 1 may also effectively resist impact from the external environment and reduce a probability of damage of the tub assembly 2.

It may be understood that when the tub assembly 2 includes the drum and the tub, an end of the damping assembly 3 may be connected to the tub, and when the clothing treatment device 100 includes a suspender 6, an end of the suspender 6 is connected to the tub, and another end of the suspender 6 is connected to the housing 1, to bear weight of the tub assembly 2; when the tub assembly 2 is provided with only the drum, the tub assembly 2 may include a water receiving tray arranged out of the drum, an end of the damping assembly 3 may be connected to the water receiving tray, and when the clothing treatment device 100 includes a suspender 6, an end of the suspender 6 is connected to the water receiving tray, and another end of the suspender 6 is connected to the housing 1, to bear weight of the tub assembly 2.

In this embodiment, descriptions are made by an example of the tub assembly 2 including the drum and the tub.

It may be understood that when the clothing treatment device is in an operation condition of washing or spin-drying, the drum rotates, and clothes in the drum may shift during rotation of the drum, so that the center of gravity of the drum may shift, and thus the drum rotates eccentrically, resulting in vibration and deflection of the tub. When eccentricity of rotation of the drum increases, amplitude of the tub may also increase correspondingly, which makes the tub assembly easily hit the housing and affect the spin-drying process.

The damping assembly 3 is a structure with a damping function. The damping assembly 3 provided in this embodiment is intended to absorb vibration energy of the tub assembly 2 when the clothing treatment device 100 is in the operation condition of washing or spin-drying, to reduce vibration displacement of the tub assembly 2 and reduce a probability of the tub assembly 2 hitting the housing 1.

Figure 5:
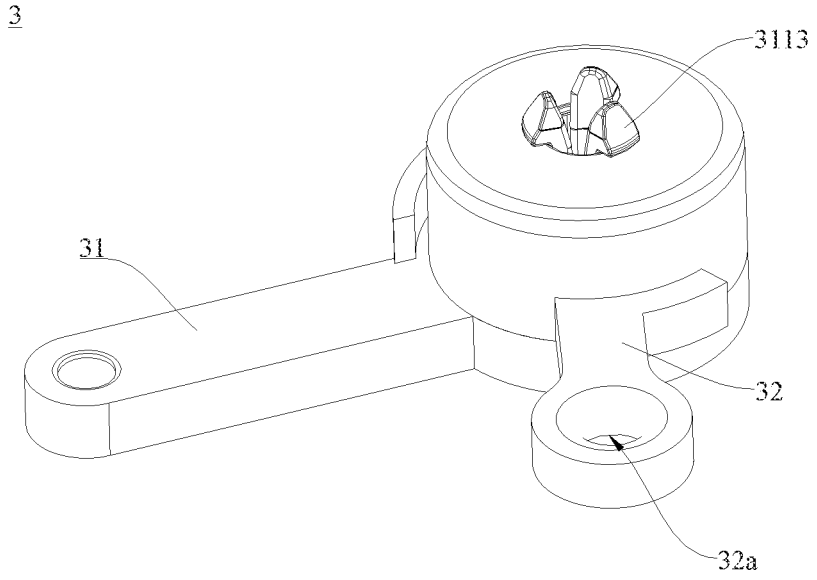
FIG. 5 is a schematic structural diagram of a damping assembly shown in FIG. 1.

With reference to FIG. 1 and FIG. 5, the first rod 4 is arranged out of the tub assembly 2, the damping assembly 3 includes a first connection end and a second connection end, the first connection end is connected to the tub assembly 2, and the second connection end is connected to the first rod 4.

That is, the damping assembly 3 is connected to the tub assembly 2 through the first connection end, and connected to a component out of the tub assembly 2 through the second connection end. It may be understood that the tub assembly 2 may also be provided with a rod, to achieve connection with the first connection end through the rod.

It should be noted that the first rod 4 arranged out of the tub assembly 2, means that the first rod 4 is a component independent of the tub assembly 2 and arranged out of the tub assembly 2. For example, the first rod 4 may be arranged on the suspender 6, an operation platform 7 or the housing 1, which is not limited here.

Figure 9:
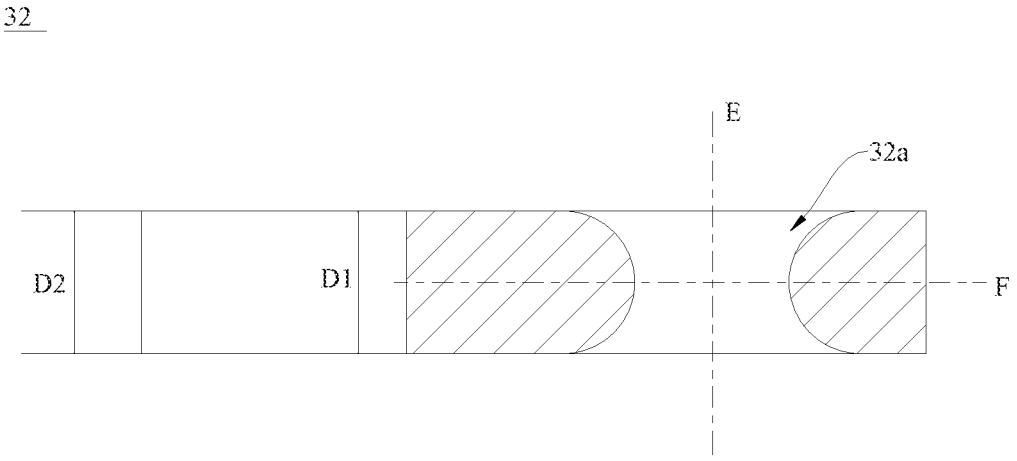
FIG. 9 is a schematic structural diagram of a second connection end of a second movement member shown in FIG. 5.

At least one of the first connection end or the second connection end is provided with a through hole 32*a*, and with reference to FIG. 9, in directions from axially opposite ends of the through hole 32*a* to an middle position of the through hole 32*a* along an axial direction thereof, a hole wall of the through hole 32*a* extends toward an axis E of the through hole 32*a*.

Aperture of the through hole 32*a* gradually decreases in directions from opposite ends of the through hole 32*a* along the axial direction thereof to the middle position of the through hole 32*a* along the axial direction thereof, the aperture of the through hole 32*a* at the middle position along the axial direction is smaller than apertures of the through hole 32*a* at two ends along the axial direction, and the aperture of the through hole 32*a* is approximately distributed to be large at two ends and small in the middle.

It should be noted that the damping assembly 3 has at least a degree of freedom (DOF) of moving up and down, a DOF of swinging up and down and a DOF of rotating circumferentially, under action of the through hole 32*a*.

When the through hole 32*a* is arranged at the first connection end, the first connection end may move up and down, rotate circumferentially, and swing up and down relative to the tub assembly 2. When the clothing treatment device 100 is in the operation condition of washing or spin-drying, the tub assembly 2 vibrates and deflects, and vibration energy is transmitted to the damping assembly 3. Under action of vibration, the first connection end of the damping assembly 3 moves up and down, rotates circumferentially, and swings up and down relative to the tub assembly 2 under action of vibration, to adapt to variation of different vibration directions of the tub assembly 2, and vibration of the tub assembly 2 forces the damping assembly 3 to absorb the vibration energy, to suppress vibration amplitude of the tub assembly 2.

When the through hole 32*a* is arranged at the second connection end, the second connection end may move up and down along the first rod 4, rotate around a circumferential direction of the first rod 4, and swing up and down relative to the first rod 4. When the clothing treatment device 100 is in the operation condition of washing or spin-drying, the tub assembly 2 vibrates and deflects, and vibration energy is transmitted to the damping assembly 3. Under action of vibration, the second connection end of the damping assembly 3 moves up and down, rotates circumferentially, and swings up and down relative to the first rod 4 under action of vibration, to adapt to variation of different vibration directions of the tub assembly 2, and vibration of the tub assembly 2 forces the damping assembly 3 to absorb the vibration energy, to suppress vibration amplitude of the tub assembly 2.

The through hole 32*a* arranged at the second connection end is taken as an example, a gap between the first rod 4 and the hole wall of the through hole 32*a* gradually increases in directions from the middle position of the through hole 32*a* along the axial direction thereof to opposite ends of the through hole 32*a* along the axial direction thereof, so that when the tub assembly 2 vibrates and deflects, the through hole 32*a* implements that the second connection end moves up and down along the first rod 4 and rotates around the circumferential direction of the first rod 4, while may also provide a movement space for the second connection end to swing up and down. In this way, the second connection end has multiple movement DOFs through the through hole 32*a* only, and operation reliability of the damping assembly 3 is improved. Furthermore, the aperture of the through hole 32*a* at the middle position along the axial direction is minimal, which also facilitates improving assembly stability of the through hole 32*a* and the first rod 4. It may be understood that in this embodiment, the first rod 4 has enough extension length to satisfy an up-down movement stroke of the second connection end.

A pulsator clothing treatment device is taken as an example, in case that an external size of a housing is unchanged, a gap between a tub assembly and the housing becomes smaller and smaller with the increase of a washing volume. During washing or spin-drying, the tub assembly may vibrate and deflect, and easily hit the housing, which affects usage safety of the clothing treatment device.

In the related art, in order to reduce amplitude of the tub assembly, the clothing treatment device is provided with a damper, an end of the damper is connected to the tub assembly, another end of the damper is connected to a suspender, the connection end of the damper rotates around a circumferential direction of the suspender or slides along the suspender, and when the tub assembly vibrates, the damper moves with the tub assembly to dissipate vibration energy. However, when the damper moves with vibration of the tub assembly, there is a large probability of sticking the damper, which affects damping effect and may even lead to damage of the damper.

According to the clothing treatment device 100 provided in the embodiments of the disclosure, when the tub assembly 2 vibrates and deflects, the damping assembly 3 achieves up-down movement, circumferential rotation and up-down swing relative to the tub assembly 2 or the first rod 4 through the through hole 32*a*, to adapt to variation of vibration displacement of the tub assembly 2, an end of the damping assembly 3 connected to the tub assembly 2 or an end of the damping assembly 3 connected to a component out of the tub assembly 2 has at least three movement DOFs, and the damping assembly 3 has high movement smoothness and low sticking probability, thereby facilitating the damping assembly 3 to buffer vibration of the tub assembly 2, and reducing a probability of the tub assembly 2 hitting the housing 1. Furthermore, the damping assembly 3 has at least three movement DOFs through the structure of the through hole 32*a* only, which also enables the overall structure of the damping assembly 3 to be simpler and manufactured easily.

In some embodiments, with reference to FIG. 9, the through hole 32*a* is symmetrical with respect to a first plane F, and the first plane F is a plane perpendicular to the axis E of the through hole 32*a* and passing through the middle position of the through hole 32*a* along the axial direction thereof.

That is, the through hole 32*a* is symmetrical with respect to the axis E thereof, while also symmetrical with respect to the first plane F, and the through hole 32*a* is a centrosymmetric structure, and a symmetrical center thereof is an intersection point of the first plane F and the axis E thereof.

In this embodiment, the configuration of the through hole 32*a* enables movement ranges at different angles to be more uniform when the first connection end or the second connection end rotates circumferentially and swings up and down, thereby improving movement stability of the first connection end or the second connection end. When the tub assembly 2 returns to a stationary state, it also facilitates the damping assembly 3 to return to an initial position following the tub assembly 2, improving movement reliability of the damping assembly 3.

In some embodiments, in a longitudinal cross section passing through the axis E of the through hole 32*a*, at least a part of cross section of the hole wall of the through hole 32*a* is in a shape of an arc projecting toward the axis E of the through hole 32*a*.

In this embodiment, the cross section of the hole wall of the through hole 32*a* is in a shape of an arc projecting toward the axis E of the through hole 32*a*, and the shape may be an entire arc, or a pattern formed by a combination of an arc section and a linear section or a combination of an arc section and a curve section, which is not limited here.

In this way, enough movement space is provided for the first connection end or the second connection end, while it may also facilitate the first connection end to achieve stable assembly with the tub assembly 2 through the through hole 32*a*, or it may also facilitate the second connection end to achieve stable assembly with the first rod 4 through the through hole 32*a*.

Exemplarily, in some embodiments, with reference to FIG. 9, the cross section of the hole wall of the through hole 32*a* is in a shape of an arc projecting toward the axis E of the through hole 32*a*, and the arc may also reduce movement resistance of the first connection end or the second connection end, so that movement of the first connection end is smoother.

It may be understood that at least a part of the cross section may be a part of the cross section or all of the cross section.

In some embodiments, with reference to FIG. 9, at least a part of cross section of the hole wall of the through hole 32*a* is in a shape of a circular arc. In this way, when it enables movement of the first connection end or the second connection end to be smoother, it may also reduce difficulty of forming the through hole 32*a* and difficulty of manufacturing the damping assembly 3.

In some embodiments, with reference to FIG. 9, the through hole 32*a* is arranged at the second connection end. The circular arc is a semicircular arc, and diameter D1 of the semicircular arc is equal to thickness D2 of the second connection end, that is, D1=D2.

In this embodiment, the diameter of the cross section of the through hole 32*a* is equal to the thickness of the second connection end, so that when the tub assembly 2 vibrates and deflects, the second connection end has enough up-down swing range relative to the first rod 4, to adapt to vibration displacements of the tub assembly 2 in different vibration directions, to reduce a probability of sticking movement of the second connection end, improve movement stability of the damping assembly 3, and also reduce difficulty of manufacturing the damping assembly 3.

Specific configuration of the damping assembly 3 is not limited.

Figure 6:
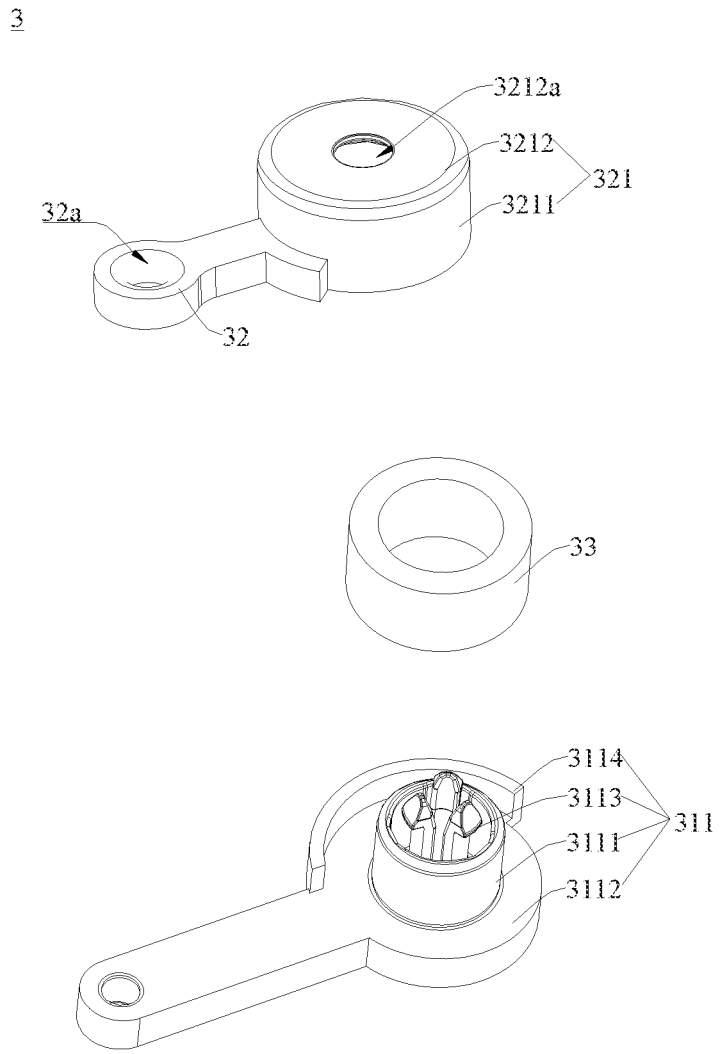
FIG. 6 is a schematic exploded view of the structure shown in FIG. 5.

In some embodiments, with reference to FIG. 5 and FIG. 6, the damping assembly 3 includes a first movement member 31, a second movement member 32 and a friction member 33, the first movement member 31 is connected to the second movement member 32, and the first movement member 31 and the second movement member 32 are relatively rotatable around their joint, the friction member 33 is arranged at the rotation joint of the first movement member 31 and the second movement member 32, to provide friction force to achieve damping when the first movement member 31 and the second movement member 32 rotate relatively, an end of the first movement member 31 away from the friction member 33 defines the first connection end, and an end of the second movement member 32 away from the friction member 33 defines the second connection end.

That is, the end of the first movement member 31 away from the friction member 33 is connected to the tub assembly 2, and the end of the second movement member 32 away from the friction member 33 is connected to the first rod 4. When the through hole 32*a* is arranged at the first connection end, the first movement member 31 may have a DOF of moving up and down, a DOF of rotating circumferentially and a DOF of swinging up and down through the through hole 32*a*; when the through hole 32*a* is arranged at the second connection end, the second movement member 32 may have a DOF of moving up and down, a DOF of rotating circumferentially and a DOF of swinging up and down through the through hole 32*a*.

It should be noted that the friction member 33 refers to a structure of which the material itself has friction damping characteristics.

It should be noted that the first movement member 31 and the second movement member 32 relatively rotatable around their joint, means that at least one of the first movement member 31 or the second movement member 32 may rotate with their joint as a center, so that the first movement member 31 and the second movement member 32 may rotate relatively.

When the tub assembly 2 vibrates and deflects, the first movement member 31 or the second movement member 32 have a DOF of moving up and down, a DOF of rotating circumferentially and a DOF of swinging up and down, while the first movement member 31 and the second movement member 32 may also relatively rotate around their joint. The damping assembly 3 has at least four movement DOFs and has high movement smoothness, further reducing a probability of sticking the damping assembly 3. Furthermore, when the first movement member 31 and the second movement member 32 rotate relatively, they rub against the friction member 33 to generate friction damping, and the friction damping may be used as damping force for the damping assembly 3 to reduce vibration of the tub assembly 2, so that buffering vibration of the tub assembly 2 is achieved.

In this embodiment, the first movement member 31 and the second movement member 32 rotate relatively, to rub against the friction member 33 to generate friction force, thereby limiting vibration amplitude of the tub assembly 2 and reducing vibration displacement of the tub assembly 2. The friction member 33 is arranged between the first movement member 31 and the second movement member 32, that is, the friction member 33 does not directly contact the tub assembly 2 or the first rod 4, so that abrasion generated by the friction member 33 may be small. Furthermore, when the first movement member 31 and the second movement member 32 rotate relatively, the friction member 33 may also isolate the first movement member 31 from the second movement member 32, to reduce abrasion generated by direct friction when the first movement member 31 and the second movement member 32 rotate, so that service life of the damping assembly 3 may be prolonged.

Material of the friction member 33 is not limited. For example, the friction member 33 may be made of a polyurethane foam material with high abrasion resistance or a soft rubber material with high abrasion resistance, has a high friction coefficient on its surface, and may generate deformation to fit with the first movement member 31 and the second movement member 32. The friction member 33 may also be made of a semi-metallic friction material or the like, which is not limited here.

Figure 8:
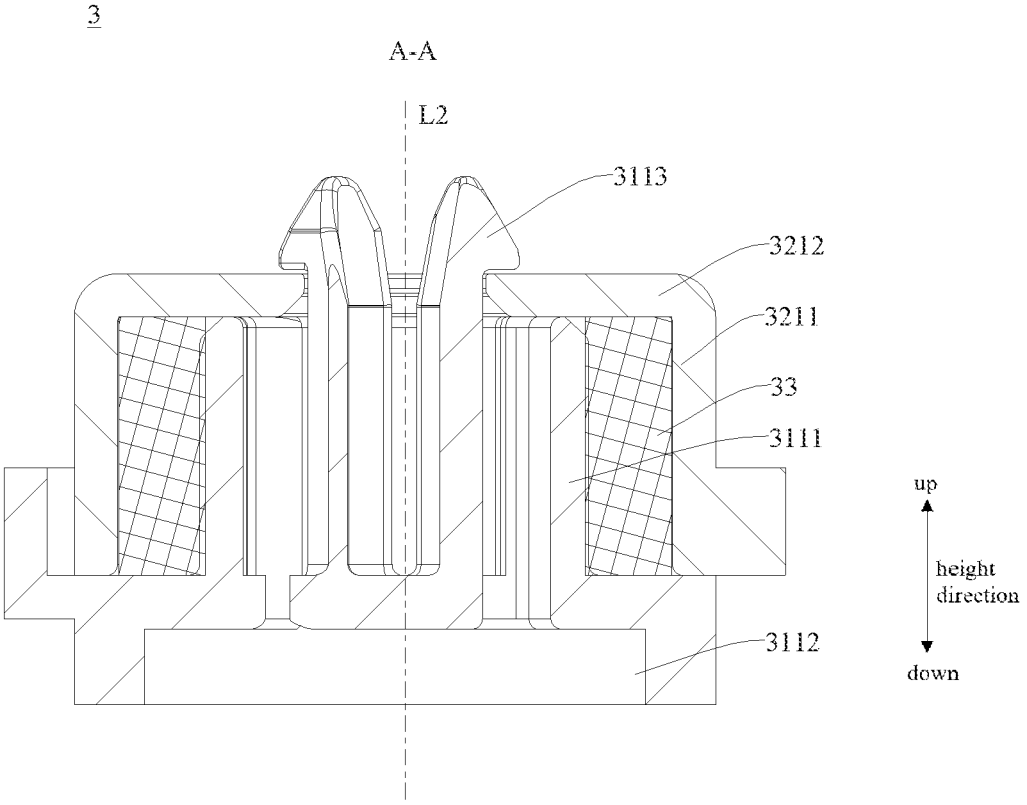
FIG. 8 is a schematic cross-sectional view of the structure shown in FIG. 7 along A-A.

In some embodiments, with reference to FIG. 1 and FIG. 8, an axis L2 around which the first movement member 31 and the second movement member 32 rotate relatively is substantially parallel to an axis L1 of the tub assembly 2. That is, the axis L2 around which the first movement member 31 and the second movement member 32 rotate relatively is substantially parallel to a height direction.

"Substantially parallel to" means that an angle between the axis L2 around which the first movement member 31 and the second movement member 32 rotate relatively and the axis L1 of the tub assembly 2 may be 0° or close to 0°, that is, certain machining and assembly errors are allowed. Exemplarily, the angle between the axis L2 around which the first movement member 31 and the second movement member 32 rotate relatively and the axis L1 of the tub assembly 2 is 0° ~5°, such as 0°, 0.3°, 0.5°, 0.7°, 0.9°, 1°, 1.2°, 1.4°, 1.6°, 1.8°, 2°, 3°, 4°, 5°, etc.

It may be understood that in the operation condition of washing or spin-drying, the tub assembly may vibrate in a horizontal direction and in the height direction, and mainly vibrates in the horizontal direction. Vibration displacement of the tub assembly in the height direction is small and is not easy to hit the tub, while vibration displacement of the tub assembly in the horizontal direction is large and is easy to exceed a horizontal gap between the housing and the tub assembly to hit the housing. Therefore, it is necessary to effectively suppress horizontal vibration of the tub assembly. Rotation axes of a first movement member and a second movement member of a damping component provided in the related art are substantially parallel to the horizontal direction, that is, the first movement member and the second movement member mainly swing along a vertical plane, damping force against vibration is mainly decomposed into force along the height direction, and component force along the horizontal direction is small, so that horizontal vibration of the tub assembly cannot be effectively absorbed, and damping effect is limited.

It may be understood that the horizontal direction refers to a direction parallel to a horizontal plane after the clothing treatment device 100 is placed on the horizontal ground, such as a left-right direction, a front-back direction, and other horizontal directions intersecting the left-right direction and the front-back direction.

In this embodiment, when the tub assembly 2 vibrates and deflects, the first movement member 31 and the second movement member 32 of the damping assembly 3 may relatively rotate around their joint. Since the axis L2 around which the first movement member 31 and the second movement member 32 rotate relatively is substantially parallel to the height direction, that is, the first movement member 31 and the second movement member 32 relatively rotate in the horizontal direction, friction force generated by the friction member 33 is substantially in the horizontal direction, which may be substantially used to reduce horizontal vibration of the tub assembly 2, effectively suppress the horizontal vibration of the tub assembly 2, reduce vibration displacement of the tub assembly 2, and reduce a probability of the tub assembly 2 hitting the housing 1.

In some embodiments, with reference to FIG. 1, the clothing treatment device 100 includes a second rod 5 extending in a height direction and fixed to an outer circumferential side of the tub assembly 2, an end of the first movement member 31 away from the friction member 33 is sleeved on an outer circumference of the second rod 5 and is rotatable around a circumferential direction of the second rod 5, and the through hole 32*a* is arranged at the second connection end.

In this embodiment, the through hole 32*a* is arranged at the second connection end, that is, the second movement member 32 may have a DOF of rotating circumferentially, a DOF of swinging up and down and a DOF of sliding up and down through the through hole 32*a*.

In this embodiment, when the tub assembly 2 vibrates and deflects, vibration energy of the tub assembly 2 is transmitted to the damping assembly 3, the end of the first movement member 31 sleeved on the second rod 5 rotates around the circumferential direction of the second rod 5, and an end of the second movement member 32 away from the first movement member 31 rotates around the circumferential direction of the first rod 4, and swings and moves up and down relative to the first rod 4. Furthermore, the first movement member 31 and the second movement member 32 may relatively rotate around their joint, the damping assembly 3 has at least five movement DOFs, and a probability of sticking its movement is low.

In some embodiments, the entire first movement member 31 is a rigid member and has only one rotation DOF; and/or, the entire second movement member 32 is a rigid member.

It should be noted that the rigid member is a single element forming a mechanism, and is a rigid body with equivalent movement to an adjacent member. The rigid member is a basic unit forming the mechanism in mechanism and having a determined relative movement relationship there-between. DOF refers to a number of independent coordinates required to describe a mechanical system. A movement DOF means that the first movement member 31 is movable in only one direction and movements in other directions are constrained.

The first movement member 31 has only one rotation DOF, i.e., a rotation DOF around the circumferential direction of the second rod 5, so that the entire damping assembly 3 may be adaptively changed with variation of the position of the tub assembly 2 under action of vibration, while the entire damping assembly 3 also has enough mounting stability.

The entire first movement member 31 is a rigid member, and when an end of the first movement member 31 away from the second movement member 32 rotates around the circumferential direction of the second rod 5, the entire first movement member 31 may be driven to rotate around the circumferential direction of the second rod 5. When the entire second movement member 32 is a rigid member, and when an end of the second movement member 32 away from the first movement member 31 rotates around the circumferential direction of the first rod 4, the entire second movement member 32 may be driven to rotate around the circumferential direction of the first rod 4, so that the first movement member 31 and the second movement member 32 may relatively rotate around their joint.

Each of the first movement member 31 and the second movement member 32 may be an integrated member, which has a simple structure and is manufactured and molded easily.

The position where the first rod 4 is arranged, is not limited.

For example, in some examples, with reference to FIG. 1, the clothing treatment device 100 includes multiple suspenders 6, an end of each of the suspenders 6 is connected to the tub assembly 2, another end of each of the suspenders 6 is connected to the housing 1, the tub assembly 2 is suspended from the housing 1 by multiple suspenders 6.

Top ends of the suspenders 6 are fixed to the housing 1, bottom ends of the suspenders 6 are fixed to the tub assembly 2, there are four suspenders 6 in number, top ends of the four suspenders 6 correspond to four corners at a top end of the housing 1, and bottom ends of the four suspenders 6 are fixed to side walls of the tub assembly 2 corresponding to the four corners of the housing 1. In this way, each suspender 6 may uniformly share weight of the tub assembly 2 and improve mounting stability of the clothing treatment device 100.

With reference to FIG. 1, the first rod 4 is a part of the suspender 6.

In this embodiment, the first movement member 31 is connected to the tub assembly 2, the second movement member 32 is connected to the suspender 6 through the through hole 32*a*, there is enough mounting space between the tub assembly 2 and the suspender 6 to arrange the damping assembly 3, the suspender 6 has enough structural strength to facilitate providing enough movement support for the damping assembly 3, and the second movement member 32 may not disengage from the suspender 6, thereby improving mounting stability of the damping assembly 3. Furthermore, the damping assembly 3 is not directly connected to the housing 1, and vibration energy of the tub assembly 2 is transmitted to the housing 1 through the damping assembly 3 and the suspenders 6, so that vibration energy received by the housing 1 may be reduced, and operation stability of the clothing treatment device 100 may be improved.

In this embodiment, the second movement member 32 is sleeved on the suspender 6, and when the tub assembly 2 vibrates and deflects, an end of the second movement member 32 away from the first movement member 31 may slide along an extension direction of the suspender 6, rotate around a circumferential direction of the suspender 6, and swing up and down relative to the suspender 6, and the first movement member 31 rotates around the circumferential direction of the second rod 5, to adapt to variation of different vibration positions of the tub assembly 2, and reduce a probability of sticking movements of the first movement member 31 and the second movement member 32, so that the damping assembly 3 have high operation reliability.

In some other embodiments, the first rod 4 may also be connected to the suspender 6. The suspender 6 may provide support for the first rod 4, thereby providing enough support for the second movement member 32.

It may be understood that the suspender 6 may also be provided with a damping structure to buffer vibration of the tub assembly 2. Exemplarily, with reference to FIG. 1, the clothing treatment device 100 includes a damping cylinder 63, a base 64 arranged at a bottom end of the suspender 6, and a damping spring 62 arranged on the suspender 6 and sandwiched between the damping cylinder 63 and the base 64. A connection slot 2*a* is formed on an outer circumferential wall at a bottom end of the tub assembly 2, and the connection slot 2*a* is sleeved on the damping cylinder 63. The damping cylinder 63 is sleeved on the suspender 6, the damping spring 62 is a compression spring, an end of the damping spring 62 abuts against a bottom end of the damping cylinder 63, and another end of the damping spring 62 abuts against the base 64. In this way, when the tub assembly 2 vibrates during washing or spin-drying, the damping spring 62 slides up and down along the suspender 6 to absorb longitudinal vibration energy of the tub assembly 2, thereby reducing vibration noise of the housing 1 and improving operation stability of the clothing treatment device 100.

The number of damping assemblies 3 is not limited. Exemplarily, with reference to FIG. 1, there are four damping assemblies 3 in number, there are four second rods 5 in number, an end of each of the four damping assemblies 3 is connected to a respective one of the second rods 5, and another end of each of the four damping assemblies 3 is connected to a respective one of the suspenders 6, so that the damping assemblies 3 may uniformly and sufficiently buffer vibration of the tub assembly 2 from different directions, increase damping effect, and improve operation safety of the clothing treatment device 100.

Figure 10:
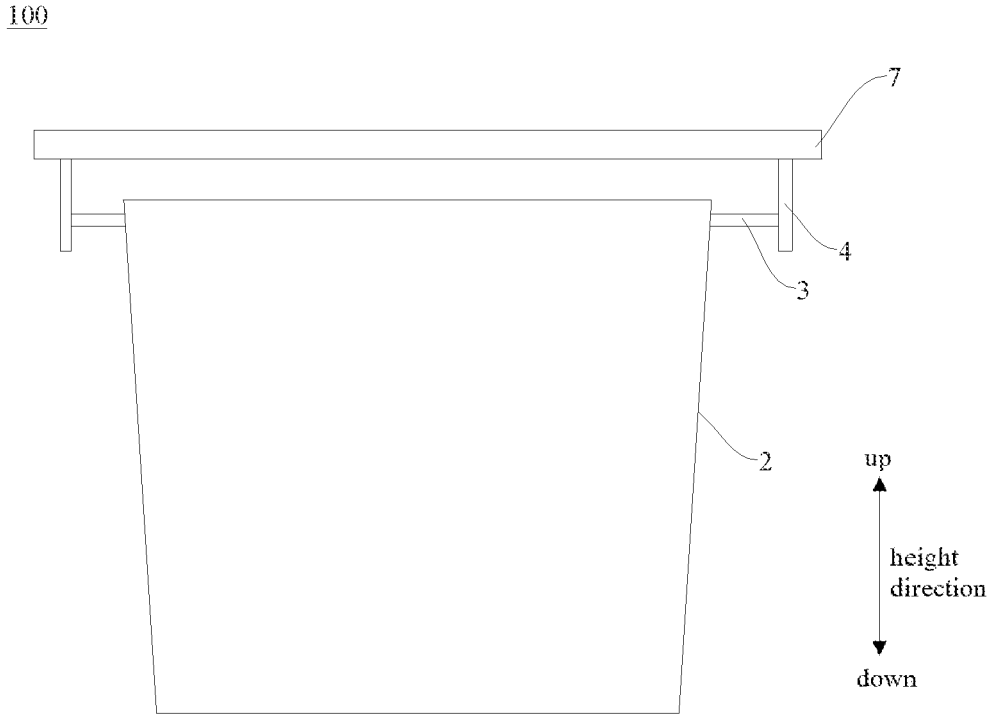
FIG. 10 is a schematic structural diagram of a clothing treatment device according to another embodiment of the disclosure.

In some other examples, with reference to FIG. 10, the clothing treatment device 10 includes an operation platform 7 arranged at a top end of the housing 1, an end of the first rod 4 is connected to the operation platform 7, and another end of the first rod 4 extends downward from the operation platform 7 to form a suspended free end, or extends downward and then is connected to a lower part or a bottom plate of the housing 1.

It may be understood that the operation platform 7 is located at a top side of the housing 1, and the operation platform 7 is provided with a clothing access port communicated with the clothing treatment chamber, that is, to-be-cleaned clothes may be put into the clothing treatment chamber from the top side through the clothing access port, and cleaned clothes may also be taken out from the clothing treatment chamber through the clothing access port.

In this embodiment, the second movement member 32 is connected to the operation platform 7 through the first rod 4, the first movement member 31 is connected to the tub assembly 2, and the tub assembly 2 and the operation platform 7 jointly provide mounting support for the damping assembly 3, to improve mounting stability and movement stability of the damping assembly 3. Furthermore, the damping assembly 3 is not directly connected to the housing 1, vibration energy of the tub assembly 2 is transmitted to the housing 1 through the damping assembly 3 and the operation platform 7, and the operation platform 7 may share a part of the vibration energy for the housing 1, which may reduce vibration noise of the housing 1 and improve operation stability of the clothing treatment device 100.

Furthermore, the first rod 4 extends downward from the operation platform 7, and an axis of the first rod 4 is in the height direction, so that resistance of movement of the second movement member 32 around the first rod 4 may be reduced.

Figure 11:
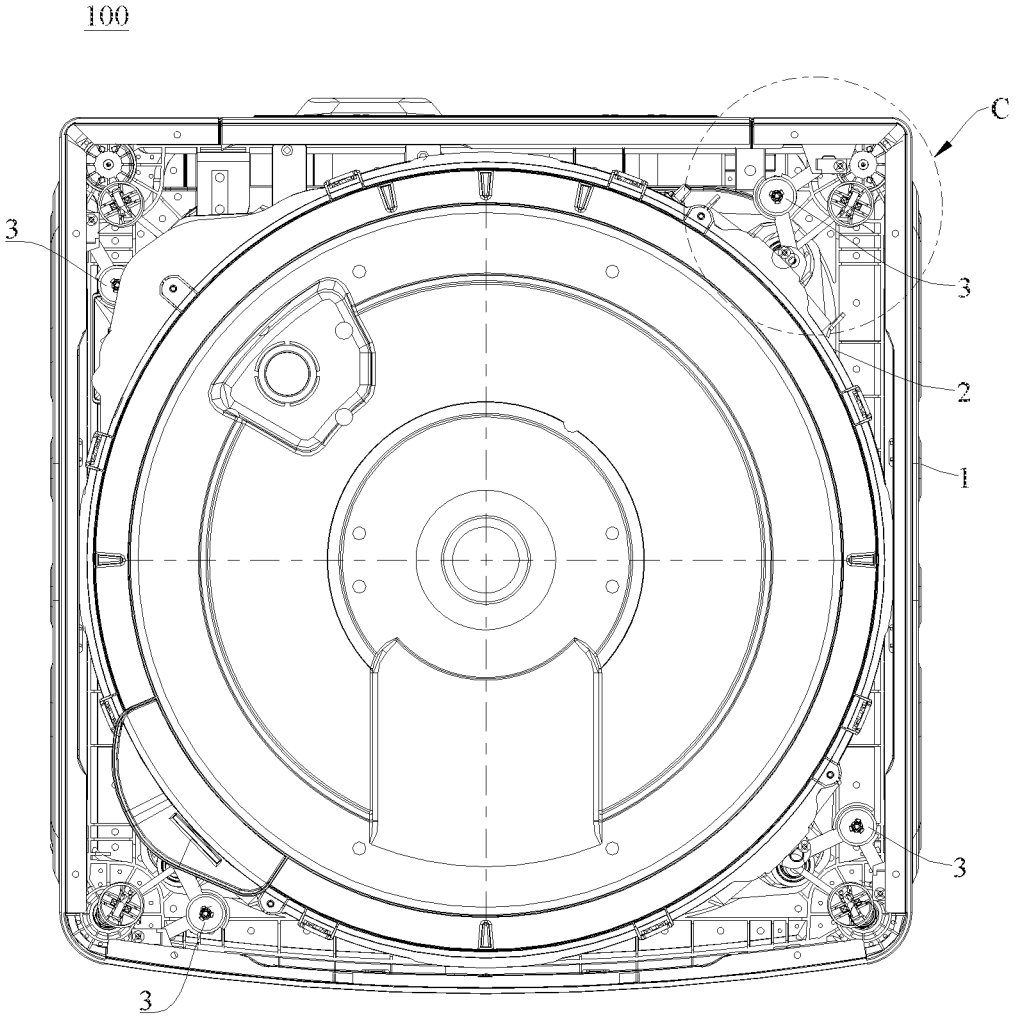
FIG. 11 is a schematic structural diagram of a clothing treatment device according to yet another embodiment of the disclosure.
Figure 12:
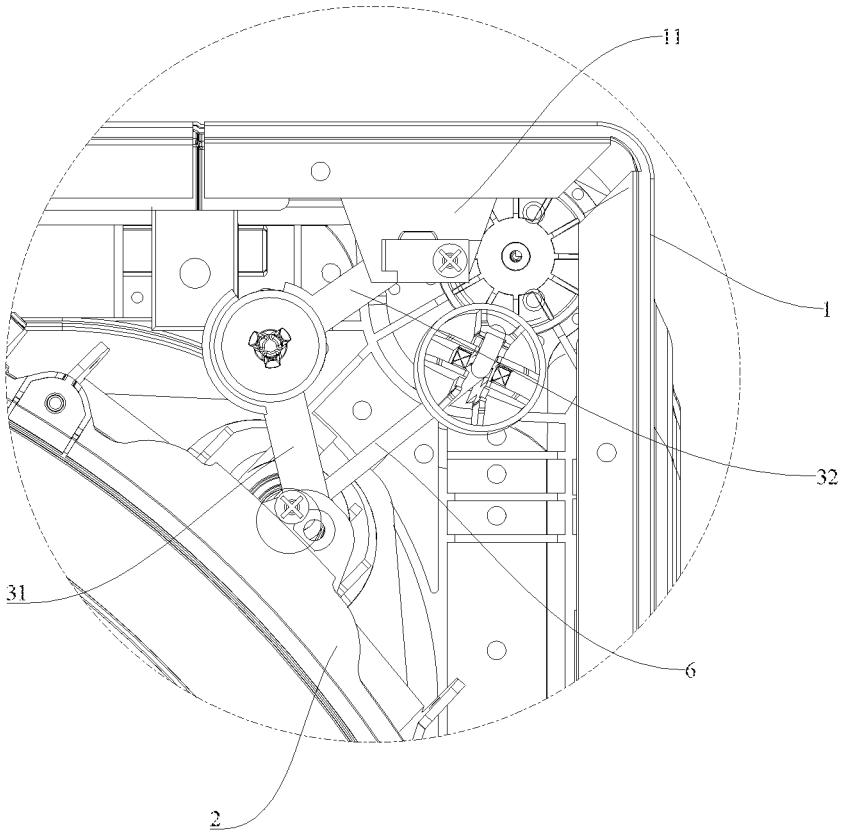
FIG. 12 is a schematic enlarged view at C of FIG. 11.
Figure 13:
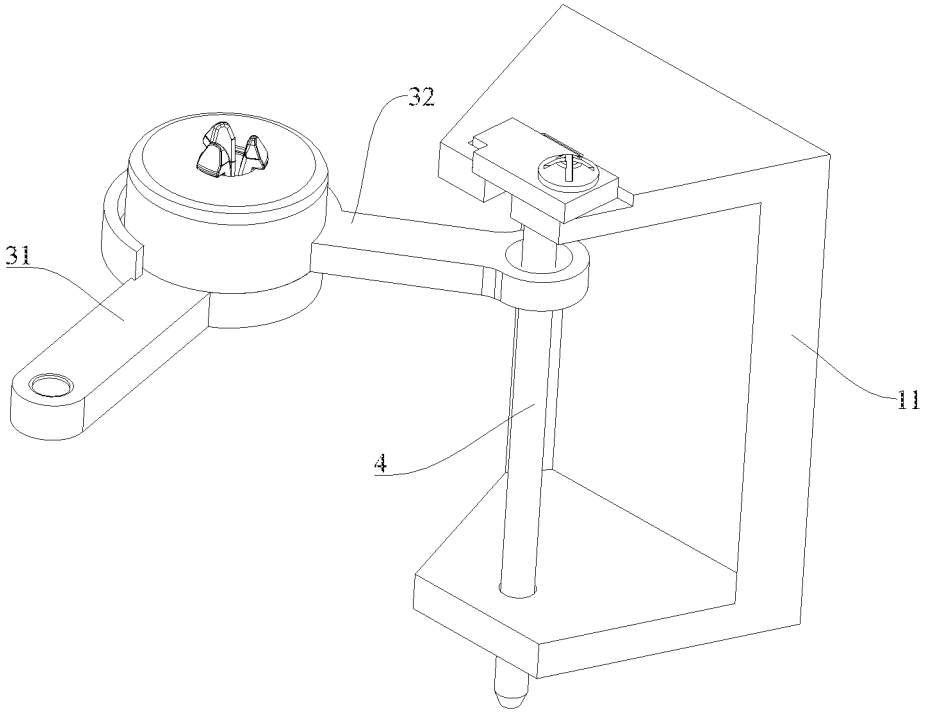
FIG. 13 is a schematic structural diagram of fitting of a damping assembly and a mounting seat of FIG. 11.

In some other examples, with reference to FIG. 11 to FIG. 13, the clothing treatment device 100 includes a mounting seat 11 arranged on the housing 1, and at least one end of the first rod 4 is arranged on the mounting seat 11.

In this embodiment, the first movement member 31 is connected to the housing 1, the second movement member 32 is connected to the tub assembly 2, and the tub assembly 2 and the housing 1 jointly provide support for the damping assembly 3. In this way, the damping assembly 3 has enough mounting space and movement space, to facilitate buffering vibration of the tub assembly 2.

Manners used to implement that the first movement member 31 has only one rotation DOF, are not limited.

In some embodiments, with reference to FIG. 1, the tub assembly 2 includes at least two mounting blocks 21 projecting from an outer circumferential wall of the tub assembly 2, the two mounting blocks 21 are arranged at an interval in the height direction, two ends of the second rod 5 are fixed to the mounting blocks 21, and the first movement member 31 is sleeved on a portion of the second rod 5 between the two mounting blocks 21, and abuts against the two mounting blocks 21 respectively.

In this way, on one hand, it may improve stability of the second rod 5 fixed to the tub assembly 2 and reduce a probability of the second rod 5 disengaging from the tub assembly 2, and it may also reduce a probability of the first movement member 31 disengaging from the second rod 5; on the other hand, the two mounting blocks 21 constrain sliding DOF of the first movement member 31 in an extension direction of the second rod 5, so that the first movement member 31 has only movement DOF of rotating around the circumferential direction of the second rod 5.

Specific configurations of the first movement member 31 and the second movement member 32 are not limited.

In some embodiments, with reference to FIG. 5 to FIG. 8, the first movement member 31 includes a first connection seat 311, the second movement member 32 includes a second connection seat 321, the first connection seat 311 includes a first annular portion 3111, the second connection seat 321 includes a second annular portion 3211, the first annular portion 3111 and the second annular portion 3211 are nested with each other and provided with an annular space in a radial direction, and the friction member 33 is arranged in the annular space.

It should be noted that each of the first annular portion 3111 and the second annular portion 3211 is an annular structure which is connected end-to-end and is not provided with notches in a circumferential direction. Nested arrangement of the first annular portion 3111 and the second annular portion 3211 means that the first annular portion 3111 is embedded in the second annular portion 3211, or the second annular portion 3211 is embedded in the first annular portion 3111; the annular space is a space between the first annular portion 3111 and the second annular portion 3211, the friction member 33 is arranged in the annular space, that is, the friction member 33 is arranged between the first annular portion 3111 and the second annular portion 3211. When the first movement member 31 and the second movement member 32 rotate relatively, the first annular portion 3111 and the second annular portion 3211 rotate relatively, and thus rub against the friction member 33 to generate friction force.

In this embodiment, the first movement member 31, the second movement member 32 and the friction member 33 are connected together by the nested fitting of the first annular portion 3111 and the second annular portion 3211, so that the overall structure of the damping assembly 3 is simple and mounted easily, and a probability of damage of the friction member 33 during assembly may also be reduced.

In some embodiments, with reference to FIG. 5 to FIG. 8, the first connection seat 311 includes a first end plate 3112 connected to the first annular portion 3111, the second connection seat 321 includes a second end plate 3212 connected to the second annular portion 3211, the first end plate 3112 and the second end plate 3212 are arranged in parallel, and the first annular portion 3111 and the second annular portion 3211 are located between the first end plate 3112 and the second end plate 3212.

It should be noted that the first end plate 3112 and the second end plate 3212 arranged in parallel, refers to a position relationship provided by the first end plate 3112 and the second end plate 3212 after docking of the first movement member 31 and the second movement member 32 is completed.

In this embodiment, the first end plate 3112 and the second end plate 3212 may provide support for the first annular portion 3111 and the second annular portion 3211, and the first annular portion 3111 and the second annular portion 3211 are defined between the first end plate 3112 and the second end plate 3212, so that docking stability of the first annular portion 3111 and the second annular portion 3211 may be improved, a loosening probability of docking of the first annular portion 3111 and the second annular portion 3211 may be reduced, while a probability of the friction member 33 disengaging from the annular space may also be reduced, and the friction member 33 may be isolated from other components out of the damping assembly 3, so that there is satisfactory mounting stability of the damping assembly 3. Furthermore, the first end plate 3112 and the second end plate 3212 are arranged in parallel, so that smoothness of the first movement member 31 and the second movement member 32 when they rotate relatively may be further increased.

In some embodiments, with reference to FIG. 5 to FIG. 8, the second annular portion 3211 surrounds an outer circumference of the first annular portion 3111, the second end plate 3212 is provided with a penetration hole 3212*a*, the first connection seat 311 further includes one or more elastic hooks 3113 arranged into an inner space of the first annular portion 3111, an end of the elastic hook 3113 is connected to the first end plate 3112, and another end of the elastic hook 3113 passes through the penetration hole 3212*a* and is connected to a surface at a side of the second end plate 3212 away from the first end plate 3112.

The elastic hook 3113 refers to a structure which plays an elastic function and may be deformed.

When the first movement member 31 is docked with the second movement member 32, the friction member 33 is arranged on the outer circumference of the first annular portion 3111, then the penetration hole 3212*a* of the second annular portion 3211 passes through the elastic hook 3113 from top to bottom, and the elastic hook 3113 is deformed elastically during pass. When the second annular portion 3211 completely surrounds the outer circumference of the first annular portion 3111, the elastic hook 3113 extends out of the penetration hole 3212*a*, recovers from deformation, and abuts against the side of the second end plate 3212 away from the first end plate 3112, thereby connecting the first connection seat 311 and the second connection seat 321 together, reducing a probability of the second connection seat 321 disengaging from the first connection seat 311, and improving mounting stability of the damping assembly 3.

The number of elastic hooks 3113 is not limited, and there may be one, two, or more than three elastic hooks. Exemplarily, with reference to FIG. 6, there are three elastic hooks 3113 in number.

In some other embodiments, the first annular portion 3111 surrounds an outer circumference of the second annular portion 3211, the first connection seat 311 is provided with a penetration hole, the second connection seat 321 includes one or more elastic hooks arranged into an inner space of the second annular portion 3211, an end of the elastic hook is connected to the second end plate 3212, and another end of the elastic hook passes through the penetration hole and is connected to a surface at a side of the first end plate 3112 away from the second end plate 3212.

In some embodiments, with reference to FIG. 5 to FIG. 8, the first connection seat 311 further includes a limit structure 3114 arranged on the first end plate 3112 and located at an outer circumferential side of the first annular portion 3111, and the limit structure 3114 is configured to form stop-fitting with the second movement member 32 in a circumferential direction, to limit a maximum rotation angle when the second movement member 32 rotates relative to the first movement member 31.

It should be noted that in an initial state, an angle between the first movement member 31 and the second movement member 32 is a first angle, and the initial state is a position where the first movement member 31 and the second movement member 32 are located when the tub assembly 2 is in a stationary state. The second movement member 32 rotates relative to the first movement member 31 when the tub assembly 2 vibrates and deflects, an angle between the second movement member 32 and the first movement member 31 is a second angle when the second movement member 32 abuts against the limit structure 3114, and a maximum rotation angle of the second movement member 32 rotating relative to the first movement member 31 is a difference between the second angle and the first angle.

It may be understood that a first end of the first movement member 31 is connected to a first end of the second movement member 32, and the angle between the first movement member 31 and the second movement member 32 is an angle between a line connecting centers of first and second ends of the first movement member 31 and a line connecting centers of first and second ends of the second movement member 32. The second end of the first movement member 31 is an end of the first movement member 31 away from the friction member 33, and the second end of the second movement member 32 is an end of the second movement member 32 away from the friction member 33.

It may be understood that when the tub assembly vibrates and deflects, the first movement member and the second movement member rotate relatively under action of vibration, and when the position of the second movement member rotating relative to the first movement member exceeds a critical position, resistance of the first movement member and the second movement member returning to the initial state is increased greatly, so that the first movement member and the second movement member cannot adaptively move according to variation of the vibration position of the tub assembly, resulting in that vibration of the tub assembly cannot be suppressed effectively, reducing damping reliability of the damping assembly.

In this embodiment, when the second movement member 32 rotates to the maximum rotation angle relative to the first movement member 31, the second movement member 32 forms stop-fitting with the limit structure 3114, and the limit structure 3114 prevents the second movement member 32 from rotating in a direction of increasing the relative rotation angle, to control the angle of the second movement member 32 rotating relative to the first movement member 31 to be within a suitable range, thereby reducing resistance of the first movement member 31 and the second movement member 32 returning to the initial state and improving damping reliability of the damping assembly 3.

In some other embodiments, the limit structure may be arranged at the second connection seat 321, the limit structure is arranged on the second end plate 3212 and located at an outer circumferential side of the second annular portion 3211, and the limit structure is configured to form stop-fitting with the first movement member 31 in a circumferential direction, to limit a maximum rotation angle when the first movement member 31 rotates relative to the second movement member 32.

In some examples, the angle between the first movement member 31 and the second movement member 32 does not exceed 180°. That is, an angle between a line connecting centers of first and second ends of the first movement member 31 and a line connecting centers of first and second ends of the second movement member 32 does not exceed 180°.

It may be understood that "the angle does not exceed 180°" means that before or during the first movement member 31 and the second movement member 32 rotate relatively, one of the first movement member 31 and the second movement member 32 is taken as a reference, then an angle between the line connecting centers of first and second ends of the first movement member 31 and the line connecting centers of first and second ends of the second movement member 32 in the same direction does not exceed 180°. For example, with reference to FIG. 7, the first movement member 31 is taken as a reference, then an angle between the line connecting centers of first and second ends of the first movement member 31 and the line connecting centers of first and second ends of the second movement member 32 in a counter-clockwise direction shown in the figure does not exceed 180° at all times.

In this embodiment, the angle between the first movement member 31 and the second movement member 32 is configured so that relative position variation of the first movement member 31 and the second movement member 32 may be limited to a reasonable range, to facilitate the first movement member 31 and the second movement member 32 to adaptively move with variation of the vibration position of the tub assembly 2, and improve damping reliability of the damping assembly 3.

Figure 7:
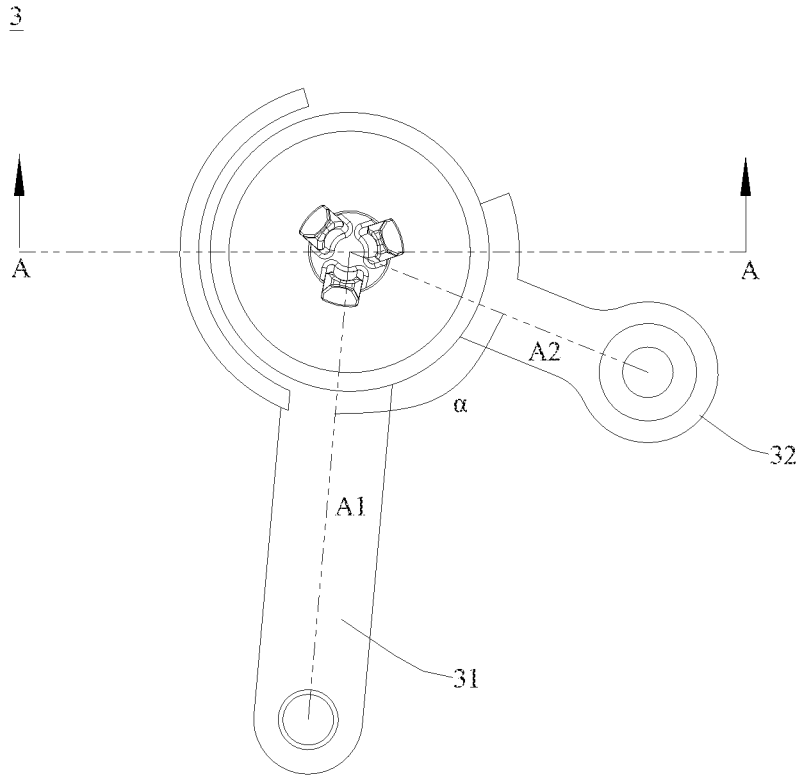
FIG. 7 is a schematic structural diagram of the structure shown in FIG. 5 from another perspective.

In some examples, with reference to FIG. 7, when the tub assembly 2 is in a stationary state, the angle between the first movement member 31 and the second movement member 32, i.e., an angle $\alpha$ between a line A1 connecting centers of first and second ends of the first movement member 31 and a line A2 connecting centers of first and second ends of the second movement member 32 is not less than 50° and not greater than 120°, that is, 50° ≤α≤120°, such as 50°, 55°, 60°, 63°, 69°, 72°, 75°, 86°, 90°, 95°, 100°, 110°, 120°, etc.

In this embodiment, when the tub assembly 2 is in a stationary state, the angle between the first movement member 31 and the second movement member 32 is within a suitable range, which on one hand, facilitates the first movement member 31 and the second movement member 32 to rotate relatively under vibration of the tub assembly 2, and on the other hand, enables the second movement member 32 to have enough rotation range when it rotates relative to the first movement member 31, improving damping reliability of the damping assembly 3.

In some examples, a position where the first movement member 31 is connected to the second rod 5 is a first position 3*a*, a position where the second movement member 32 is connected to the first rod 4 is a second position 3*b*, and in a planar projection perpendicular to a height direction of the clothing treatment device 100, when the tub assembly 2 is in a stationary state, a line L3 connecting centers of projections of the first position 3*a* and the second position 3*b* is substantially perpendicular to a tangent line L4 of the tub assembly 2 at the first position 3*a*.

"Substantially perpendicular to" means that an angle between the line L3 connecting centers of projections of the first position 3*a* and the second position 3*b* and the tangent line L4 of the tub assembly 2 at the first position 3*a* may be 90° or close to 90°, that is, certain machining and assembly errors are allowed. Exemplarily, the angle β between the line L3 connecting centers of projections of the first position 3*a* and the second position 3*b* and the tangent line L4 of the tub assembly 2 at the first position 3*a* is 85° ~95°, that is, 85°≤β≤95°, such as 85°, 86°, 87°, 88°, 89°, 90°, 91°, 92°, 93°, 94°, 95°, etc.

Figure 4:
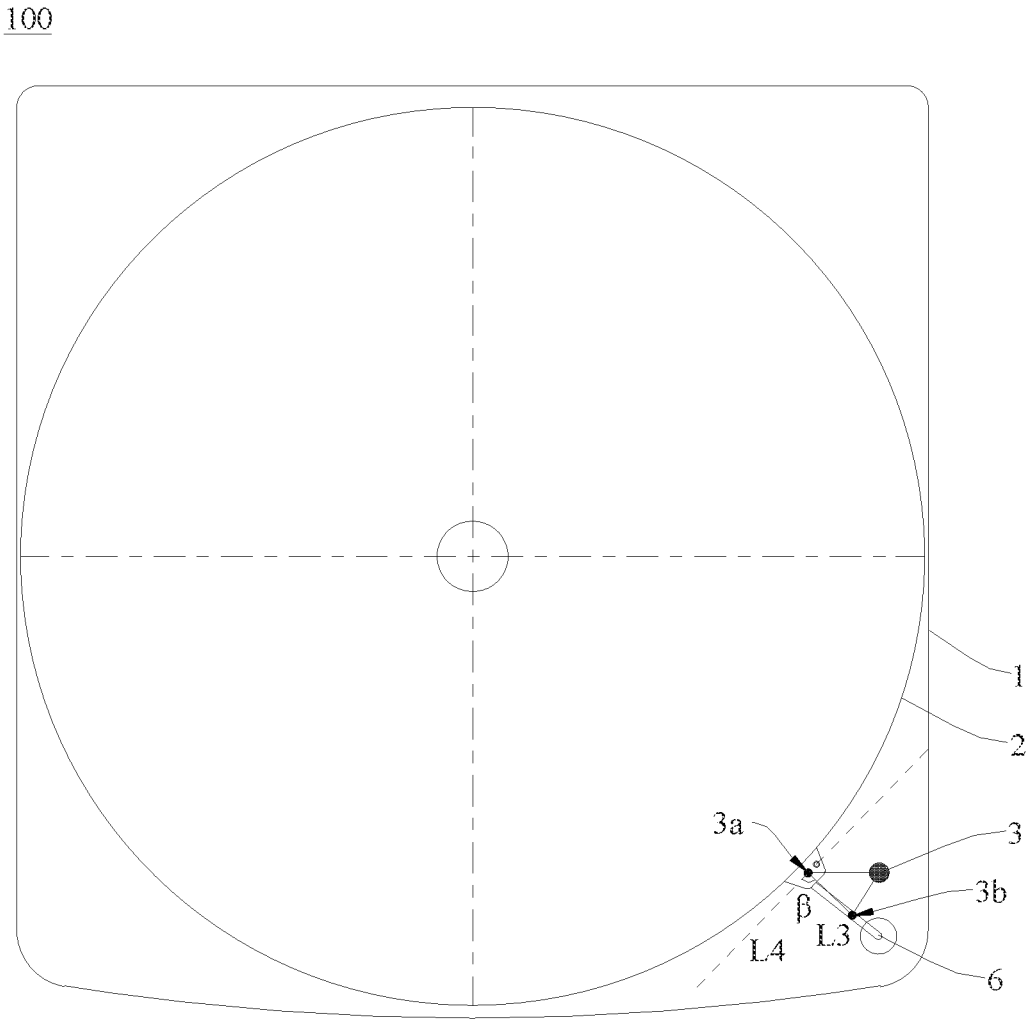
FIG. 4 is a schematic structural diagram of the structure shown in FIG. 1 from yet another perspective.

FIG. 4 is taken as an example, the second rod 5 is connected to the tub assembly 2, the first rod 4 is a part of the suspender 6, and the angle β is the angle between the line L3 connecting centers of projections of the first position 3*a* and the second position 3*b* and the tangent line L4 of the tub assembly 2 at the first position 3*a*.

In this embodiment, the range of the angle β enables the damping assembly 3 to be in a relatively stable state when the tub assembly 2 is in a stationary state, and resistance of the damping assembly 3 moving with vibration of the tub assembly 2 may be small when the tub assembly 2 vibrates and deflects, which facilitates improving operation reliability of the damping assembly 3.

Movement mode of the damping assembly 3 according to an embodiment of the disclosure will be briefly described below with reference to FIG. 1.

The first movement member 31 is sleeved on the second rod 5, the second rod 5 is fixed to the tub assembly 2, the first rod 4 is a part of the suspender 6, the through hole 32*a* is a part of the second movement member 32, and the second movement member 32 is sleeved on the suspender 6 through the through hole 32*a*. When the tub assembly 2 vibrates, an end of the second movement member 32 away from the first movement member 31 may rotate around the circumferential direction of the suspender 6, swing up and down relative to the suspender 6, and slide along the extension direction of the suspender 6, and the first movement member 31 may rotate around the circumferential direction of the second rod 5.

In this embodiment, the damping assembly 3 has five movement DOFs in total, i.e., a rotation DOF of rotating around the circumferential direction of the second rod 5, a rotation DOF of rotating around the circumferential direction of the suspender 6, a swing DOF of swinging up and down relative to the suspender 6, a sliding DOF of sliding along the suspender 6, and a DOF of the first movement member 31 and the second movement member 32 rotating relatively. The damping assembly 3 has a low probability of sticking its movement, may adapt to vibration displacements of the tub assembly 2 in different vibration directions, and has high damping reliability.

In descriptions of the disclosure, descriptions of reference terms "an embodiment", "some embodiments", "example", "specific example", or "some examples" or the like, mean that specific features, structures, materials or characteristics described in combination with the embodiment or example are included in at least one embodiment or example of the embodiments of the disclosure. In the disclosure, schematic representations of the above terms are not necessarily directed to the same embodiment or example. Furthermore, specific features, structures, materials or characteristics as described may be combined in a suitable manner in any one or more embodiments or examples. Furthermore, those skilled in the art may combine different embodiments or examples described in the disclosure and features of different embodiments or examples, without mutual conflict.

The above descriptions are only preferred embodiments of the disclosure, and are not intended to limit the disclosure. For those skilled in the art, various modifications and variations may be made to the disclosure. Any modification, equivalent replacement, improvement, or the like made within the spirit and principle of the disclosure should be included in the scope of protection of the disclosure.

The invention claimed is:

1. A clothing treatment device comprising:

a housing;

a tub assembly, arranged in the housing;

a first rod, arranged out of the tub assembly; and a damping assembly, comprising a first connection end and a second connection end, wherein the first connection end is connected to the tub assembly, and the second connection end is connected to the first rod, wherein at least one of the first connection end or the second connection end is provided with a through hole, and in directions from axially opposite ends of the through hole to a middle position of the through hole along an axial direction thereof, a hole wall of the through hole extends toward an axis of the through hole.

2. The clothing treatment device of claim 1, wherein the through hole is symmetrical with respect to a first plane, and wherein the first plane is a plane perpendicular to the axis of the through hole and passing through the middle position of the through hole along the axial direction thereof.

3. The clothing treatment device of claim 1, wherein in a longitudinal cross section passing through the axis of the through hole, at least a part of the cross section of the hole wall of the through hole is in a shape of an arc projecting toward the axis of the through hole.

4. The clothing treatment device of claim 3, wherein at least a part of the cross section of the hole wall of the through hole is in a shape of a circular arc.

5. The clothing treatment device of claim 1, wherein the damping assembly comprises a first movement member, a second movement member and a friction member, the first movement member is connected to the second movement member, and the first movement member and the second movement member are relatively rotatable around their joint, the friction member is arranged at a rotation joint of the first movement member and the second movement member, to provide friction force to achieve damping when the first movement member and the second movement member rotate relatively, an end of the first movement member away from the friction member defines the first connection end, and an end of the second movement member away from the friction member defines the second connection end.

6. The clothing treatment device of claim 5, wherein an axis around which the first movement member and the second movement member rotate relatively is substantially parallel to an axis of the tub assembly.

7. The clothing treatment device of claim 5, wherein a first end of the first movement member is connected to a first end of the second movement member, and when the tub assembly is in a stationary state, an angle between a line connecting centers of first and second ends of the first movement member and a line connecting centers of first and second ends of the second movement member is not less than 50° and not greater than 120°.

8. The clothing treatment device of claim 5, wherein the clothing treatment device comprises a second rod extending in a height direction and fixed to an outer circumferential side of the tub assembly, an end of the first connection end away from the friction member is sleeved on an outer circumference of the second rod and is rotatable around a circumferential direction of the second rod, and the through hole is arranged at the second connection end.

9. The clothing treatment device of claim 8, wherein the first movement member is a rigid member and has only one rotation degree of freedom.

10. The clothing treatment device of claim 8, wherein the second movement member is a rigid member.

11. The clothing treatment device of claim 8, further comprising a plurality of suspenders, wherein an end of each of the suspenders is connected to the tub assembly, another end of each of the suspenders is connected to the housing, the tub assembly is suspended from the housing by the plurality of suspenders, and the first rod is a part of one of the plurality of suspenders or the first rod is connected to one of the plurality of suspenders.

12. The clothing treatment device of claim 8, further comprising an operation platform arranged at a top end of the housing, wherein an end of the first rod is connected to the operation platform, and another end of the first rod extends downward from the operation platform.

13. The clothing treatment device of claim 8, further comprising a mounting seat arranged on the housing, wherein at least one end of the first rod is arranged on the mounting seat.

* * * * *